US008424263B2

(12) United States Patent
Hsieh

(10) Patent No.: US 8,424,263 B2
(45) Date of Patent: Apr. 23, 2013

(54) LIGHTWEIGHT FLOOR SLAB

(76) Inventor: Ying Chun Hsieh, Fengyuan (TW)

( * ) Notice: Subject to any disclaimer, the term of this patent is extended or adjusted under 35 U.S.C. 154(b) by 2 days.

(21) Appl. No.: 12/998,176

(22) PCT Filed: Sep. 28, 2009

(86) PCT No.: PCT/CN2009/001093

§ 371 (c)(1),
(2), (4) Date: Mar. 24, 2011

(87) PCT Pub. No.: WO2010/037270

PCT Pub. Date: Apr. 8, 2010

(65) Prior Publication Data

US 2011/0192105 A1 Aug. 11, 2011

(30) Foreign Application Priority Data

Sep. 28, 2008 (CN) ..... 2008 2 0133842 U

(51) Int. Cl.
*E04B 1/18* (2006.01)

(52) U.S. Cl.
USPC ..... 52/414; 52/783.17; 52/783.19; 52/443; 52/449

(58) Field of Classification Search ..... 52/414, 52/783.1, 783.11, 783.14, 783.17, 783.19, 52/783.2, 741.41, 443–447, 449–454
See application file for complete search history.

(56) References Cited

U.S. PATENT DOCUMENTS

| | | | | |
|---|---|---|---|---|
| 5,566,522 | A * | 10/1996 | Alander et al. | 52/630 |
| 6,000,194 | A * | 12/1999 | Nakamura | 52/783.17 |
| 6,578,343 | B1 * | 6/2003 | Dumler et al. | 52/783.17 |
| 6,631,599 | B1 * | 10/2003 | Takagi | 52/579 |
| 6,658,810 | B2 * | 12/2003 | DeLoach, Sr. | 52/701 |
| 7,121,053 | B2 * | 10/2006 | Toncelli et al. | 52/414 |
| 7,353,642 | B1 * | 4/2008 | Henriquez | 52/741.41 |
| 7,739,844 | B2 * | 6/2010 | Gharibeh et al. | 52/309.8 |
| 2006/0075707 | A1 * | 4/2006 | Cretti | 52/414 |

FOREIGN PATENT DOCUMENTS

| | | | |
|---|---|---|---|
| CN | 2010501270 | Y | 4/2008 |
| CN | 201056838 | Y | 5/2008 |
| CN | 201347597 | Y | 11/2009 |
| JP | 2000038796 | A | 2/2000 |

* cited by examiner

*Primary Examiner* — Basil Katcheves
*Assistant Examiner* — Beth Stephan
(74) *Attorney, Agent, or Firm* — Pearne & Gordon LLP

(57) ABSTRACT

A lightweight floor slab comprises a meshy shuttering (1), a metal mesh (3) and cement mortars (2), wherein the meshy shuttering (1) and the metal mesh (3) are formed to a whole by filing the cement mortars (2).

18 Claims, 7 Drawing Sheets

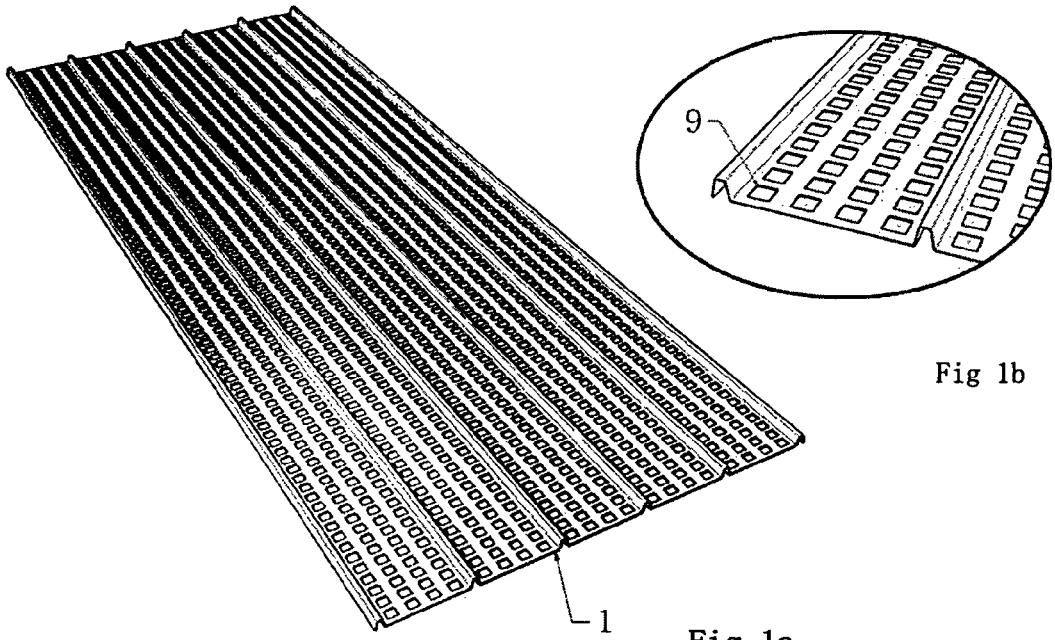
Fig 1b
Fig 1a
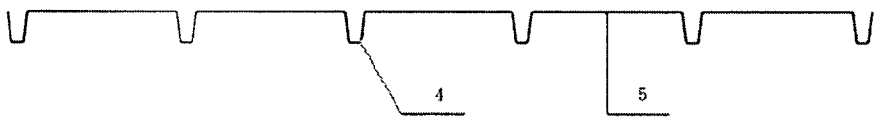
Fig 1c
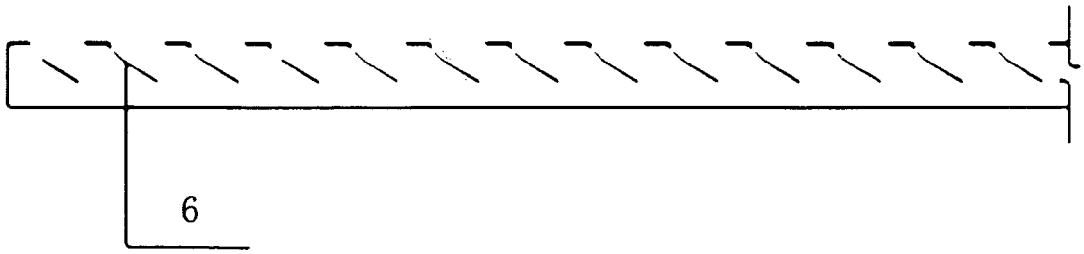
Fig 1d

LIGHTWEIGHT FLOOR SLAB

CLAIM OF PRIORITY TO RELATED APPLICATIONS

This application is a National Phase application of International Application No. PCT/CN2009/001093 filed Sep. 28, 2009, which claims priority to Chinese Utility Model application no. 200820133842.4 (CN) filed Sep. 28, 2008, which are incorporated herein by reference in their entirety, and to which priority is hereby claimed.

TECHNICAL FIELD

The present invention relates to a building material used in the construction field, and in particular to a lightweight floor slab for use in the building construction.

BACKGROUND ART

The floor slab is a main component part of the deadweight of the building structure. Too great floor slab weight requires the very high supporting intensity for the members supporting the floor slab, members connected with the floor slab and other relevant building structures, thereby increasing the construction cost. Moreover, the increased weight of the floor slab and relevant building structures correspondingly lowers the quakeproof capability of the buildings.

At present, the floor slabs for construction projects in the domestic generally are concrete floor slabs. The floor slabs having a cast-in-place steel reinforced concrete structure in the country house have a thickness of about 10 cm. Such floor slabs are mainly made of cement, sand, stone and steel, and thus have great weight. At the same time, the floor slabs have the long finishing period and the relatively high cost. Further, it's hard for these overweight floor slabs to meet the quakeproof requirement of the country house.

In addition, although use of the bamboo-wood floors in the building can reduce the weight of the floor slabs, high prominence should be given to the fire prevention of the buildings.

Thereby, the current floor slabs for constructing are obviously faced with many inconveniences and defects in terms of their structure and usage, and it is desired to improve them. In order to solve the problems in the constructing floor slabs, the manufacturers have racked their brains to seek for the solution. However, the proper designs do not come out for a long time, and the general products do not have the appropriate configuration to solve the above problems. Obviously, the relevant persons are eager for the solution of these problems.

In view of the above defects existing in the current floor slab for constructing, the present inventor creates a lightweight floor slab of a novel structure by using his rich practice experiences and professional knowledge, combing the application of theory and actively performing the research and innovation, and improves the current floor slab for constructing, thereby bringing more practicality and greatly lowering the weight of the floor slab. After a lot of research, experimentation and improvement, the present invention of great practical value is finally created.

SUMMARY OF THE INVENTION

The main object of the present invention is to overcome the defects of the current floor slab for constructing, such as great deadweight and complex manufacturing technology, and to provide a novel lightweight floor slab. The technical problem to be solved is to lower the weight of the floor slab to make it more practicable and with the industrial utilization value.

Another object of the present invention is to provide a lightweight floor slab. The technical problem to be solved is to reduce the usage amount of the steel during the process of manufacturing the floor slab, thereby reducing the cost of the floor slab and simplifying the use process and manufacturing technology thereof.

Yet, another object of the present invention is to provide a lightweight floor slab, and the technical problem to be solved is to reduce the thickness of the floor slab to make it more practicable.

The objects of the present invention and the addressed technical problems can be achieved or solved by the following technical solutions. In accordance with the present invention, a lightweight floor slab is provided that consists of a meshy shuttering, a metal mesh and cement mortars, wherein the meshy shuttering and the metal mesh are formed to a whole by filling cement mortars.

The objects of the present invention and the addressed technical problems can be achieved or solved by the following technical measures:

- the lightweight floor slab, wherein the meshy shuttering comprises mesh battens and mesh faces;
- the lightweight floor slab, wherein the mesh battens are V-shaped;
- the lightweight floor slab, wherein the mesh faces are provided with punched holes thereon;
- the lightweight floor slab, wherein dental laminas of meshy shuttering are arranged on side edges of the punched holes;
- the lightweight floor slab, wherein the dental laminas of meshy shuttering are formed during the punching process;
- the lightweight floor slab, wherein the lightweight floor slab is secured on a purline when in use;
- the lightweight floor slab, wherein the lightweight floor slab is secured on the purline by self-drilling screws; the lightweight floor slab, wherein the purline is C-shaped lightweight steel In virtue of the above technical solutions, the claimed lightweight floor slab has at least the following advantages:

(1) The meshy shuttering used in the lightweight floor slab is a perforated plate, and the dental laminas formed after the perforating are helpful to increase the bonding intensity between the cement mortar and the meshy shuttering. Steel bars are not necessary when using such a type of perforated plate, thereby reducing the usage amount of steel and simultaneously providing great intensity.

(2) The thickness of the claimed lightweight floor slab usually is 3-4 cm. Compared with the current concrete floor slab with a thickness of 10 cm, the thickness of the lightweight floor slab is greatly reduced, thereby reducing the usage amount of the concrete and making the claimed floor slab lighter.

(3) During the actual use, the construction procedure of the claimed lightweight floor slab is simplified.

(4) For the claimed lightweight floor slab, there is no need to disassemble the meshy shuttering so as to reduce the manufacture procedure of the floor slab.

In conclusion, the claimed lightweight floor slab of special configuration is more adapted for practicality thanks to the advantages of lowering the weight of the floor slab, reducing the usage amount of steel during the process of the making the floor slab, lowering the production cost of the floor slab, and simplifying the use process and manufacturing technology of the floor slab. The same kind of the product does not disclose or use the similar structural design, and thereby the claimed lightweight floor slab is novel indeed, and makes a great improvement on the structure and function, achieves the great technical advancement and produces the good and practical effects. The lightweight floor slab has many increased functions relative to the current floor slab so as to make it more adapted for the practicality and have the wide commercial utilization value. Therefore, the claimed lightweight floor slab is a novel, advanced and practical design.

The above description is only a generalization for the technical solutions of the present invention. To understand the technical means more clearly and carry out the invention according to the description, the preferred embodiments of the invention are described hereinafter in conjunction with the drawings.

Here is the specific structure of the invention as described by the embodiments and the drawings.

BRIEF DESCRIPTION OF THE DRAWINGS

FIG. 1*a* is an overall schematic view of the meshy shuttering in the embodiments of the invention;

FIG. 1*b* is a local enlarging view of the meshy shuttering shown in FIG. 1*a;*

FIG. 1*c* is a cross-sectional schematic view of the meshy shuttering in the embodiments of the invention;

FIG. 1*d* is a schematic view of the dental laminas arranged in the meshy shuttering in the embodiments of the invention;

Figure 2A:
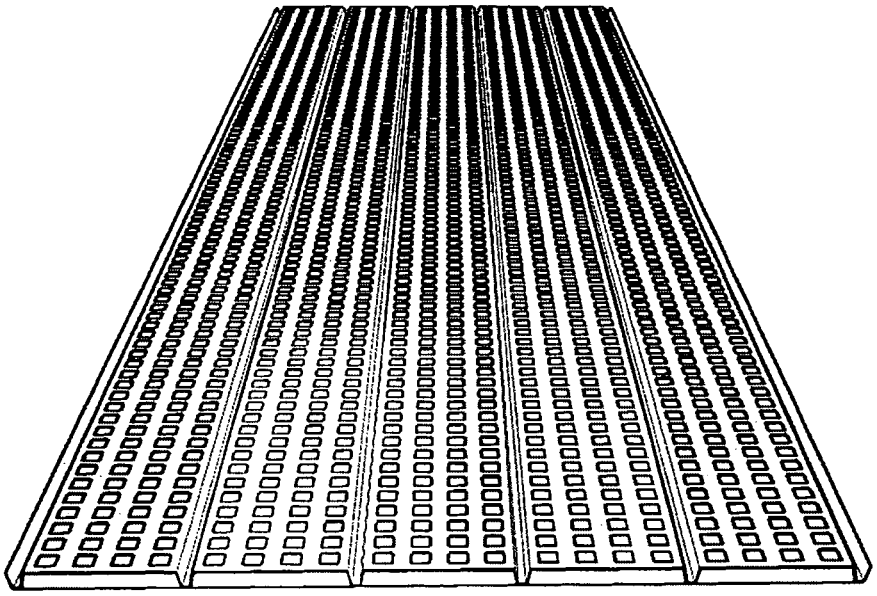
FIG. 2*a* is a schematic view after the grooves on the bottom surface of the meshy shuttering are floated with a layer of mud.

1: a meshy shuttering; 2: a layer of cement mortar; 3: a metal mesh; 4: mesh battens 5: mesh faces; 6: dental laminas; 7: a cement plastering layer; 8: purline; 9: punched holes

BEST MODE OF CARRYING OUT THE INVENTION

In order to further expound the technical means adopted for achieving the objects of the invention, the mode of carrying out the claimed lightweight floor slab and its structure, characteristics and effects are described in detail hereinafter in combination with the drawings and embodiments.

Referring to FIGS. 1*a*, 1*b*, 1*c* and 1*d*, the meshy shuttering 1 of the lightweight floor slab in a preferred embodiment of the invention mainly includes mesh battens 4 and mesh faces 5, wherein punched holes are provided on the mesh faces 5, and dental laminas 6 are provided on the side edges of the punched holes. The said mesh battens 4 may be V-shaped mesh battens or others of suitable shape.

In the preferred embodiment, a sheet of the complete meshy shuttering 1 comprises the continuously raised V-shaped mesh battens 4 and the steel mesh faces 5. The V-shaped mesh battens 4 that are arranged in a continuous and parallel manner are the main source of intensity of the meshy shuttering 1. The meshy shuttering 1 can be arc-like curved in a direction parallel to the V-shaped. The regular punched holes are provided on the mesh faces 5, and the raised dental laminas 6 on the punched holes can intensify the bonding strength between the meshy shuttering 1 and the materials.

Figure 2B:
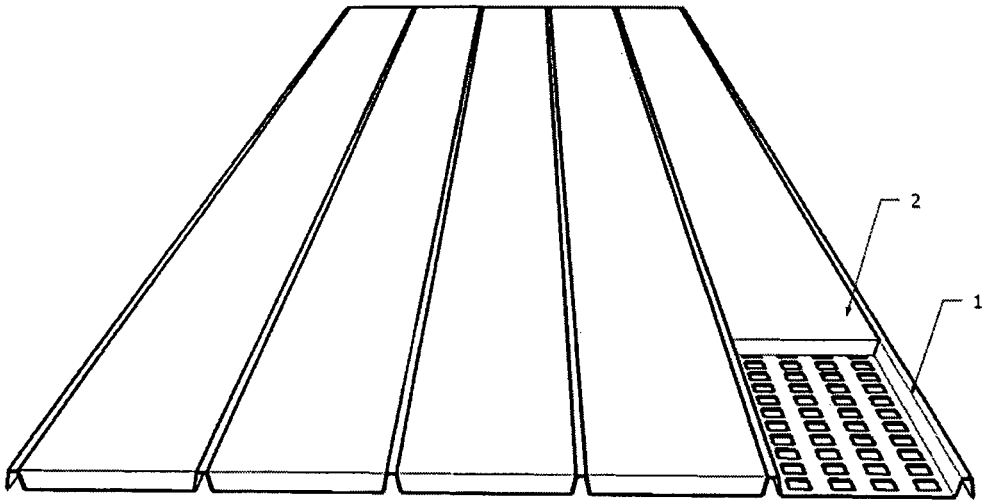
FIG. 2*b* is a local section schematic view of FIG. 2*a;*
Figure 3:
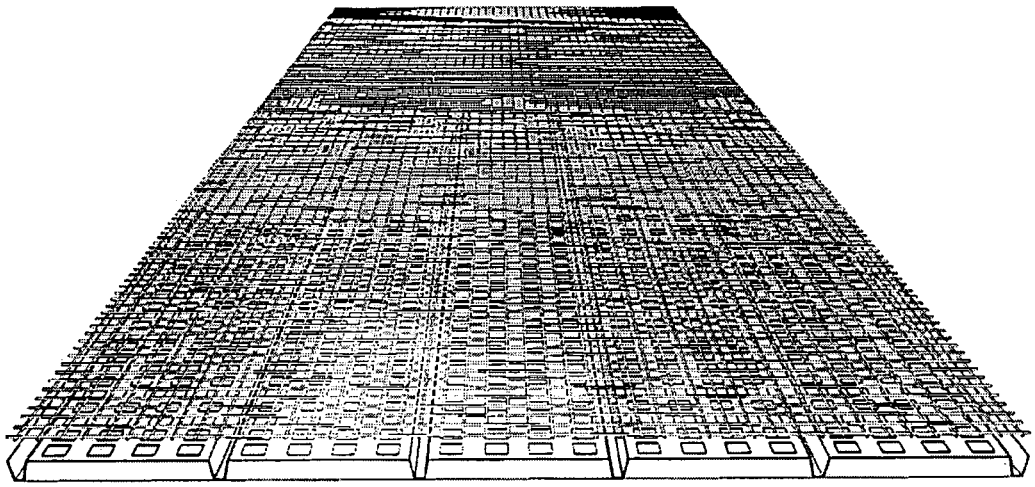
FIG. 3 is a schematic view of adhering a metal mesh to the meshy shuttering after the grooves on the bottom surface of the meshy shuttering are floated with the mud layer.

Referring to FIGS. 2*a* and 2*b*, the bottom surface of the meshy shuttering 1 of the lightweight floor slab in the preferred embodiment of the invention is coated with a cement mortar layer 2, which is flush with grooves on the bottom surface of the meshy shuttering. Referring to FIG. 3, after the front surface of the meshy shuttering 1 of the lightweight floor slab in the preferred embodiment of the invention is coated with a cement mortar layer 2 with a certain thickness, the metal mesh 3 is adhered thereto.

Figure 4A:
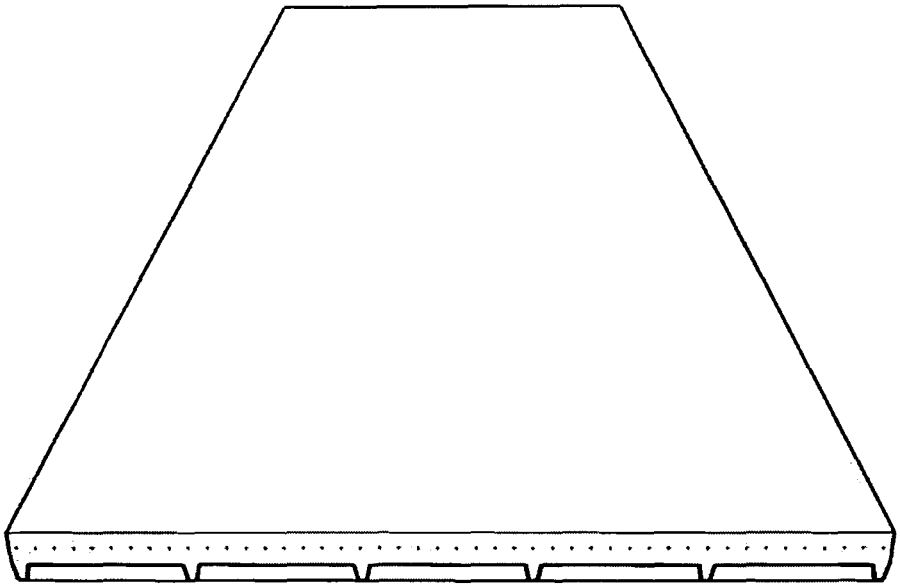
FIG. 4*a* is an overall schematic view of the claimed lightweight floor slab.
Figure 4B:
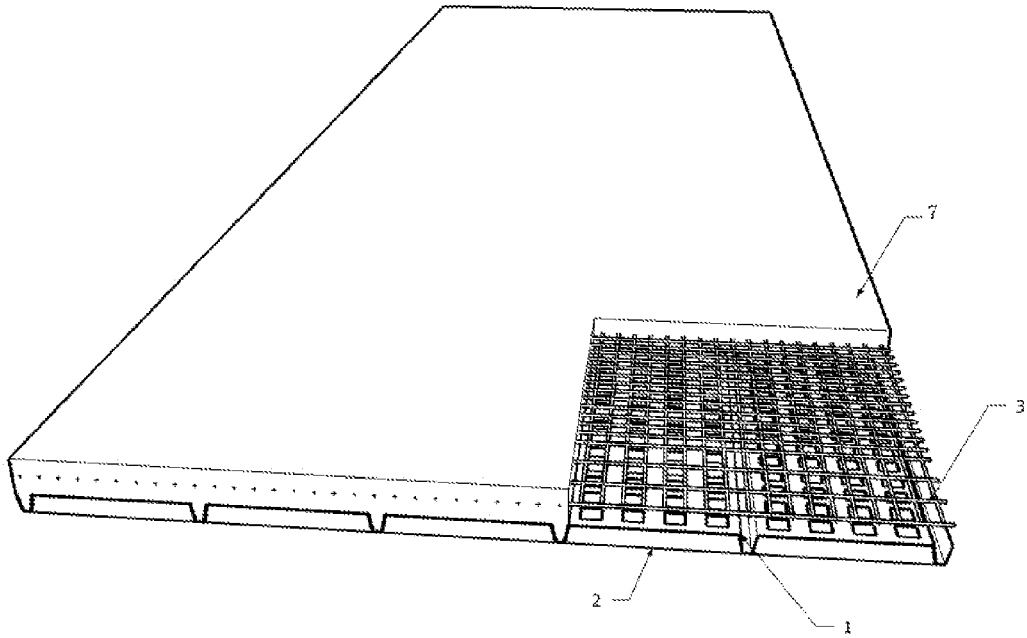
FIG. 4*b* is a local section schematic view of FIG. 4*a;*

Referring to FIGS. 4*a* and 4*b*, they are the overall schematic view and the local section schematic view of the lightweight floor slab respectively in the preferred embodiment of the invention.

Figure 5:
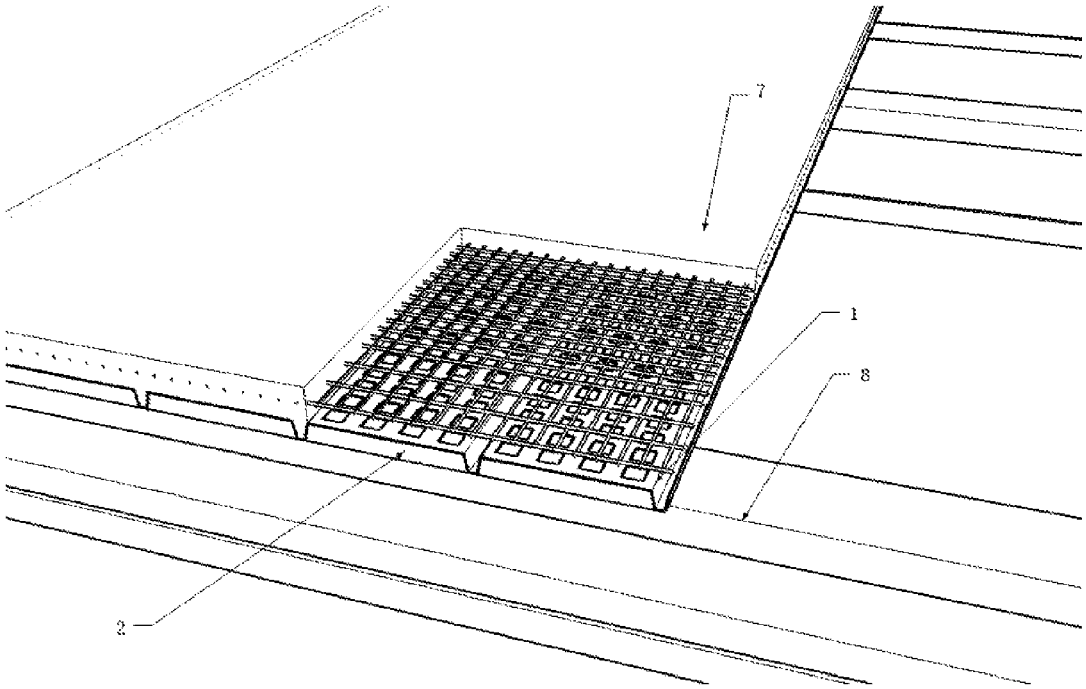
FIG. 5 shows an applicable embodiment of the lightweight floor slab.

Referring to FIG. 5, it shows an applicable embodiment of the lightweight floor slab. In the preferred embodiment, there is no need to disassemble the meshy shuttering 1 during the actual use. The meshy shuttering may be steel or other metal materials, and the metal mesh 3 may be an electrically-welded steel mesh. During the manufacturing process of the lightweight floor slab, the bottom surface of the meshy shuttering is coated with the cement mortar, and the meshy shuttering after reaching certain dryness and hardness is turned and placed on C-shaped steel purline, and then fixed at the V-shaped groove places by self-drilling screws (not shown). The layer of cement mortar is plastered on-site, and the electrically-welded steel mesh is within the layer of cement mortar. The total thickness of the lightweight floor slab is 3 cm, and this can reduce the weight of the concrete floor slab as far as possible.

The combined plate after reaching proper hardness is turned over and placed on the C-shaped steel purline, with the V-shaped grooves opening upwards. The self-drilling screws pass through the bottoms of the V-shaped grooves to be fixed with the C-shaped steel purline.

The cement mortar is evenly dispersed on the top surface of the meshy shuttering on-site, and then compacted. The electrically-welded mesh is sandwiched in the cement mortar to form a concrete combined plate, with a total thickness of 3 cm.

The inventive point of the invention lies in that the meshy shuttering is mainly used for manufacturing the floor slab of the lightweight steel-structure building.

The claimed lightweight floor slab formed by the above processes brings the technological innovation, and has many redeeming features for a person skilled in the art. Thereby, the lightweight floor slab represents technical progress.

The above description is the basis concept of the invention. However, in the technical field of the present invention, other operable embodiments can be improved by means of the basis technical knowledge. Here, the substantive technical solution of the invention is sought for patent protection, and its scope of protection shall cover all the variations having the above technical features.

The above description is only a preferred embodiment of the invention, rather than a limit to any forms of the invention. Although the particular embodiment of the present invention has been described above, it will be apparent to those skilled in the art that various changes and modifications can be made without departing from the spirit of the present invention. Any changes and modifications to the above embodiment according to the technical essence of the present invention and without departing from the spirit of the present invention shall be embraced within the technical solution of the present invention.

The invention claimed is:

1. A lightweight floor slab comprising a meshy shuttering having a length, a to surface and a bottom surface, a plurality of battens extending from the top surface below the bottom surface of the meshy shuttering providing grooves in the top surface and protrusions in the bottom surface, each protrusion extending below the bottom surface to a protrusion bottom, the protrusions providing a plurality of cavities adjacent the bottom surface between the protrusions, the battens each extending substantially the length of the shuttering, the battens substantially continuous and parallel to one another, a plurality of mesh faces respectively located on the top surface between the battens, each mesh face having a plurality of holes therein, a plurality of bottom cement mortar layers each adhered to the bottom surface of the shuttering between the battens in the cavities of the bottom surface, each layer flush with the protrusion bottoms;

a metal mesh placed on the mesh faces of the meshy shuttering; and a continuous top cement mortar layer adhered to the mesh faces and the metal mesh and extending into the grooves.

2. The lightweight floor slab according to claim 1, characterized in that the lightweight floor slab is secured on a purline when in use.

3. The lightweight floor slab according to claim 1, wherein the plurality of raised battens are V-shaped.

4. The lightweight floor slab according to claim 1, wherein the plurality of mesh faces are provided with punched holes thereon.

5. The lightweight floor slab according to claim 4, wherein dental laminas are arranged on side edges of the punched holes.

6. The lightweight floor slab according to claim 5, wherein the dental laminas are formed during a punching process of the mesh faces.

7. The lightweight floor slab according to claim 6, characterized in that the lightweight floor slab is secured on a purline when in use.

8. The lightweight floor slab according to claim 7, characterized in that the lightweight floor slab is secured on the purline by self-drilling screws.

9. The lightweight floor slab according to claim 8, characterized in that the purline is C-shaped lightweight steel.

10. The lightweight floor slab according to claim 5, characterized in that the lightweight floor slab is secured on a purline when in use.

11. The lightweight floor slab according to claim 4, characterized in that the lightweight floor slab is secured on a purline when in use.

12. The lightweight floor slab according to claim 3, characterized in that the lightweight floor slab is secured on a purline when in use.

13. A lightweight floor slab comprising:

a meshy shuttering having a length, a top surface and a bottom surface, a plurality of battens extending from the top surface below the bottom surface of the shuttering providing grooves in the top surface and protrusions in the bottom surface, each protrusion extending below the bottom surface to a protrusion bottom, the protrusions providing a plurality of cavities adjacent the bottom surface between the protrusions, the battens each extending substantially the length of the shuttering, the battens substantially continuous and parallel to one another, a plurality of mesh faces respectively located on the top surface between the battens, each mesh face having a plurality of holes therein, a plurality of dental lamina, each lamina provided on one of the holes, each lamina extends below the bottom surface of the shuttering;

a plurality of bottom cement mortar layers each adhered to the bottom surface of the meshy shuttering between the battens in the cavities of the bottom surface, each layer flush with the protrusion bottoms;

a metal mesh placed on the mesh faces of the meshy shuttering; and a continuous top cement mortar layer adhered to the mesh faces and the metal mesh and extending into the grooves.

14. The lightweight floor slab of claim 13, wherein the mesh battens are generally V-shaped, and are adapted to be secured to a purline.

15. The lightweight floor slab of claim 13, wherein the lightweight floor slab has a total thickness in the range of 3-4 cm.

16. A method of making a lightweight floor slab comprising the steps of:

providing a meshy shuttering having a length, a top surface and a bottom surface, a plurality of battens extending from the top surface below the bottom surface of the shuttering providing grooves in the top surface and protrusions in the bottom surface, each protrusion extending below the bottom surface to a protrusion bottom, the protrusions providing a plurality of cavities adjacent the bottom surface between the protrusions, the battens each extending substantially the length of the shuttering, the battens substantially continuous and parallel to one another, a plurality of mesh faces respectively located on the top surface between the battens;

providing each of the mesh faces with a plurality of holes therein;

providing a plurality of dental lamina, wherein each dental lamina is provided on one of the holes and extends below the bottom surface of the meshy shuttering;

providing a plurality of bottom cement mortar layers adhered to the bottom surface of the shuttering between the battens, the layers flush with the protrusion bottoms, providing a metal mesh placed on the mesh faces of the meshy shuttering; and providing a continuous top cement mortar layer adhered to the mesh faces and the metal mesh and extending into the grooves.

17. The method of claim 16, further comprising the step of securing the lightweight floor slab to a purline after the first coating step and before the second coating step.

18. The method of claim 16, wherein the lightweight floor slab has a total thickness in the range of 3-4 cm.

* * * * *

UNITED STATES PATENT AND TRADEMARK OFFICE

CERTIFICATE OF CORRECTION

PATENT NO. : 8,424,263 B2
APPLICATION NO. : 12/998176
DATED : April 23, 2013
INVENTOR(S) : Ying Chun Hsieh It is certified that error appears in the above-identified patent and that said Letters Patent is hereby corrected as shown below:

In the Claims

In Claim 1 at Column 5, Line 3, replace “to” with “top”.

Signed and Sealed this
Twenty-fifth Day of June, 2013

Teresa Stanek Rea
*Acting Director of the United States Patent and Trademark Office*